US007578926B2

(12) United States Patent
Abernathy et al.

(10) Patent No.: US 7,578,926 B2
(45) Date of Patent: Aug. 25, 2009

(54) PROCESS TO ENHANCE OXIDATION STABILITY OF BASE OILS BY ANALYSIS OF OLEFINS USING Â$^1$H NMR

(75) Inventors: Susan M. Abernathy, Hercules, CA (US); David R. Johnson, Petaluma, CA (US); John M. Rosenbaum, Richmond, CA (US); Don Young, Medford, OR (US)

(73) Assignee: Chevron U.S.A. Inc., San Ramon, CA (US)

( * ) Notice: Subject to any disclaimer, the term of this patent is extended or adjusted under 35 U.S.C. 154(b) by 46 days.

(21) Appl. No.: 11/111,120

(22) Filed: Apr. 20, 2005

(65) Prior Publication Data

US 2006/0237344 A1 Oct. 26, 2006

(51) Int. Cl.

| | |
|---|---|
| ***C10G 71/00*** | (2006.01) |
| ***B01J 29/70*** | (2006.01) |
| ***C10G 65/00*** | (2006.01) |
| ***C10G 65/12*** | (2006.01) |
| ***C10G 35/00*** | (2006.01) |

(52) U.S. Cl. ..... 208/18; 208/24; 208/46; 208/58; 208/61; 208/133; 208/950; 518/726; 585/258; 585/259; 585/266; 585/329

(58) Field of Classification Search ..... 208/18, 208/46, 49, 58, 61, 67, 68, 133, 950, 24; 518/726; 585/258, 259, 266, 329
See application file for complete search history.

(56) References Cited

U.S. PATENT DOCUMENTS

| | | | | |
|---|---|---|---|---|
| 3,852,207 | A * | 12/1974 | Stangeland et al. | 208/58 |
| 4,648,957 | A * | 3/1987 | Graziani et al. | 208/58 |
| 5,017,279 | A * | 5/1991 | Oswald et al. | 208/67 |
| 5,275,718 | A * | 1/1994 | Copeland et al. | 208/12 |
| 6,090,989 | A * | 7/2000 | Trewella et al. | 585/13 |
| 6,100,224 | A * | 8/2000 | Peiffer et al. | 508/235 |
| 6,458,979 | B1 * | 10/2002 | Johnson | 556/34 |
| 6,475,960 | B1 * | 11/2002 | Berlowitz et al. | 508/110 |
| 6,562,230 | B1 * | 5/2003 | O'Rear et al. | 208/66 |
| 6,730,638 | B2 * | 5/2004 | Farng et al. | 508/194 |
| 6,833,065 | B2 * | 12/2004 | O'Rear | 208/19 |
| 7,045,055 | B2 * | 5/2006 | Ziemer et al. | 208/18 |
| 7,141,157 | B2 * | 11/2006 | Rosenbaum et al. | 208/18 |
| 2001/0001804 | A1 * | 5/2001 | Skledar et al. | 585/250 |
| 2003/0120118 | A1 * | 6/2003 | Justin Betts et al. | 568/451 |
| 2003/0150776 | A1 * | 8/2003 | Johnson et al. | 208/80 |
| 2003/0199719 | A1 * | 10/2003 | Johnson et al. | 585/329 |
| 2004/0020828 | A1 * | 2/2004 | Elomari | 208/111.01 |
| 2004/0055931 | A1 * | 3/2004 | Van Beijnum et al. | 208/18 |
| 2004/0129603 | A1 * | 7/2004 | Fyfe et al. | 208/18 |
| 2004/0154958 | A1 * | 8/2004 | Alexander et al. | 208/18 |
| 2004/0159582 | A1 * | 8/2004 | Simmons et al. | 208/89 |
| 2005/0090616 | A1 * | 4/2005 | Dias et al. | 525/191 |
| 2005/0133407 | A1 * | 6/2005 | Abernathy et al. | 208/18 |
| 2006/0201852 | A1 * | 9/2006 | Rosenbaum et al. | 208/19 |
| 2006/0247138 | A1 * | 11/2006 | Rosenbaum et al. | 508/110 |
| 2006/0293193 | A1 * | 12/2006 | Rosenbaum et al. | 508/110 |

OTHER PUBLICATIONS

Burri et al. (Burri J., Crocket R., Hany R., Rentsch D.) Gasoline composition determined by 1 H NMR spectroscopy. 2004 Fuel vol. 83, pp. 187-193. available online Aug. 27, 2003.*

V. Bansal et al., Estimation of Bromine Number of Petroleum Distillates by NMR Spectroscopy, 2000 American Chemical Society, Engergy & Fuels 2000, 14, pp. 1028-1031.

Ken D. Hope et al., Achieving Enhanced Oxidative Stability for Polyalphaolefins, Copyright 2001 Society of Automotive Engineers, Inc., Paper 02SFL-103.

Timothy M. Shea et al., Modeling Base Oil Properties Using NMR Spectroscopy and Neural Networks, Tribology Transactions, vol. 45 (2003), 3, pp. 296-302.

D.C. Kramer et al., Influence of Group II & III Base Oil Composition on VI and Oxidation Stability, Prepared for Presentation at the 1999 AIChE Spring National Meeting in Houston, Mar. 14-18, 1999, Lube Session—Lubricants for the 21$^{st}$ Century.

V.J.Gatto et al., The Influence of Chemical Structure on the Physical Properties and Antioxidant Response of Hydrocracked Base Stocks and Polyalphaolefins, J. Synthetic Lubrication 19-1, Apr. 2002, Leaf Coppin, pp. 3-18.

George P. Firmstone et al., A Comparison of Neural Network and Partial Least Squares Approaches in Correlating Base Oil Composition to Lubricant Performance in Gasoline Engine Tests and Industrial Oil Applications, SAE International, SAE Technical Paper Series, 952534, pp. 201-208, (1995).

* cited by examiner

*Primary Examiner*—Walter D Griffin
*Assistant Examiner*—Huy-Tram Nguyen
(74) *Attorney, Agent, or Firm*—Susan M. Abernathy

(57) ABSTRACT

A process for producing a lubricating base oil having high oxidation stability, wherein the feed used to prepare the lubricating base oil contains at least 5 wt. % olefins, said process comprising (a) determining the weight percent of olefins present in the feed by means of $^1$H NMR; (b) hydroprocessing the feed under hydroprocessing conditions selected to reduce the amount of olefins present to a target value which has been pre-determined by means of $^1$H NMR to produce a lubricating base oil having the desired oxidation stability; and (c) collecting a lubricating base oil having the selected oxidation stability from the hydroprocessing zone.

33 Claims, 2 Drawing Sheets

PROCESS TO ENHANCE OXIDATION STABILITY OF BASE OILS BY ANALYSIS OF OLEFINS USING Â$^1$H NMR

FIELD OF THE INVENTION

The present invention is directed to a process for preparing base oil having high oxidation stability by using $^1$H NMR to analyze for the presence of olefins and hydrofinishing the base oil to a target value for olefins.

BACKGROUND OF THE INVENTION

Finished lubricants consist of two general components; lubricating base oil and additives. Lubricating base oil is the major constituent in these finished lubricants and contributes significantly to their properties. In general, a few lubricating base oils are used to manufacture a variety of finished lubricants by varying the mixtures of individual lubricating base oils and individual additives.

Base oils are usually prepared from hydrocarbon feedstocks having a major portion boiling above 650° F. Typically, the feedstocks from which lubricating base oils are prepared are recovered as part of the bottoms from an atmospheric distillation unit. This high boiling bottoms material may be further fractionated in a vacuum distillation unit to yield cuts with pre-selected boiling ranges. Most lubricating base oils are prepared from that fraction or fractions where a major portion boils above about 700° F. (about 370° C.) and below about 1050° F. (about 565° C.). Although lubricating base oils traditionally have been prepared from conventional petroleum feedstocks, recently it has been shown that high quality lubricating base oils can be prepared from synthetic feedstocks such as polyalphaolefins (PAOs) and from waxy feedstocks, such as slack wax and Fischer-Tropsch wax.

Numerous governing organizations, including Original Equipment Manufacturers (OEM's), the American Petroleum Institute (API), Association des Consructeurs d'Automobiles (ACEA), the American Society of Testing and Materials (ASTM), International Lubricant Standardization and Approval Committee (ILSAC), and the Society of Automotive Engineers (SAE), among others, define the specifications for lubricating base oils and finished lubricants. Increasingly, the specifications for engine oils and other finished lubricants are calling for products with excellent low temperature properties, high oxidation stability, and low volatility. Currently, only a small fraction of the base oils manufactured today are able to meet these demanding specifications.

Oxidation stability is an important property of base oils intended for use in the formulation of finished lubricants, and means for improving the oxidation stability for both petroleum derived and synthetic base oils has been an active of area for research. The more resistant base oil is to oxidation, the fewer tendencies the finished lubricant will have to form deposits, sludge, and corrosive byproducts in the engine. Oxidation stability also helps prevent undesirable viscosity increases during use. One method for improving oxidation stability of base oils is by saturating the double bonds present in the molecules. For example, see U.S. patent application Ser. No. 09/343,334 which describes improving the oxidative stability of PAOs by hydrogenating to a very low Bromine Index (BI).

Bromine Index (ASTM 2710-99) is the standard analytical method for measuring unsaturation in petroleum hydrocarbons. The BI represents the number of milligrams of Bromine that react with 100 gms of the sample under the conditions of the test. However, many lubricating base oils have a boiling range above the level specified for measuring BI. In addition, many of the newer synthetic hydrocarbons have hindered olefins that are not measurable by BI. Hydrocarbons which contain hindered olefins, such as PAOs, poly internal olefins, or other oligomerized base oil, give erroneously low results with conventional BI analysis. Therefore, there is a need for a method for accurately measuring olefins in hydrocarbons having boiling points over a broad range, from about 500° F. (about 260° C.) to well above 1500° F. (about 816° C.).

NMR spectroscopy has been shown to be useful for characterizing base oils and predicting bulk properties such as viscosity index, aniline point, and pour point. For example, T. M. Shea, S. Gunsel, "Modeling Base Oil Properties using NMR Spectroscopy and Neural Networks", Tribology Transactions, Vol. 45 (2003), pp. 296-302, teaches that 13C NMR may be used to measure the weight percent of aromatics and the weight percent of aliphatic carbons. See also "NMR Molecular Characterization of Lubricating Base oils: Correlation with Their Performance", L. Montanari, C. Como and S. Fattori, Applied Magnetic Resonance, 14, (1998), pp. 345-356. V. Bansal et al., "Estimation of Bromine Number of Petroleum Distillates by NMR Spectroscopy", Energy and Fuels, Vol. 14 (2000), pp. 1028-1031 describes the use of NMR in estimating the bromine numbers of fuel samples with boiling ranges from 50 to 250° C. (122 to 482° F.). However, the literature has not shown that NMR spectroscopy can be used to measure the weight percent of olefins present in high boiling hydrocarbons such as base oils. The present invention is based upon the discovery that $^1$H NMR may be used to accurately analyze for the amount of olefins present in a base oil and establish a target value which may be used to correlate with high oxidation stability.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

SUMMARY OF THE INVENTION

The present invention is directed to a process for producing a lubricating base oil having high oxidation stability, wherein the feed used to prepare the lubricating base oil contains at least 5 wt. % olefins, said process comprising (a) determining the weight percent of olefins present in the feed by means of $^1$H NMR; (b) hydroprocessing the feed under hydroprocessing conditions selected to reduce the amount of olefins present to a target value which has been pre-determined by means of $^1$H NMR to produce a lubricating base oil having the desired oxidation stability; and (c) collecting a lubricating base oil having the selected oxidation stability from the hydroprocessing zone. While the process may be used to prepare base oil products of high oxidation stability from most petroleum-derived or synthetic base oils, the invention is particularly useful with waxy feedstocks, such as feedstocks derived from a Fischer-Tropsch synthesis or from slack wax. Initially the feedstocks used in carrying out the present invention will contain a significant percent of olefins, generally at least 5 wt. % and often 15 wt. % or more. The use of $^1$H NMR to determine the amount olefins present is most useful when the olefins comprise 15 wt. % or less of the lubricating base oil. However, this limitation on olefin determination using $^{1}H$ NMR does represent a problem, since the target value must be below 15 wt. % in order to achieve acceptable oxidation stability.

In carrying out the invention, one skilled in the art will recognize that steps (a) and (b) may be carried out in the reverse order, i.e., $^{1}H$ NMR will usually be used to determine if the hydroprocessed feed has met the target value. Thus, in actual practice the invention will almost always involve at least one additional testing step in which $^{1}H$ NMR is used to determine if the hydroprocessed lubricating base oil meets the target value. In addition, the feed, especially if it is a waxy feed, will typically have been hydroisomerized prior to step (a).

As used in this disclosure, hydroprocessing refers to any process or processes which may be used to saturate olefins. Generally, hydroprocessing will include hydrofinishing, however, hydroprocessing may also include hydrotreating, hydrocracking, and hydroisomerization. The process selected to saturate the olefins will depend on the feedstocks and the final product slate. An olefinic hydrocarbon refers to a hydrocarbon containing at least one carbon to carbon double bond.

The invention also may be described as a process for producing a base oil product having high oxidation stability from a waxy feed, said process comprising (a) isomerizing the waxy feed in a hydroisomerization zone under hydroisomerization conditions, whereby an isomerized intermediate base oil is produced having (i) increased methyl branching, (ii) greater than 0.01 wt. % aromatics, and (iii) at least 5 wt. % olefins; (b) determining the weight percent of olefins present in the isomerized intermediate base oil by means of $^{1}H$ NMR; (c) if the weight percent of olefins present in the isomerized intermediate base oil as determined in step (b) exceeds a target value pre-selected to correspond to high oxidation stability, hydrofinishing the isomerized intermediate base oil in a hydrofinishing zone under hydrofinishing conditions selected to reduce the amount of olefins present to less than the target value for weight percent of olefins; and (d) collecting a base oil product having high oxidation stability from the hydrofinishing zone. Once again, it should be recognized that $^{1}H$ NMR may be used again following step (c) to determine if the target value has been met.

The target value referred to is the maximum weight percent of olefins as determined by $^{1}H$ NMR which will achieve acceptable oxidation stability for the product. Generally, the maximum weight percent of olefins is about 15 wt. % or less, with about 10 wt. % or less being preferred, and about 5 wt. % or less being especially preferred. When base oil products having even higher oxidative stability are desired, maximum values of 2.5 wt. % or less, 1 wt. % or less, and 0.5 wt. % or less of olefins, respectively, will be even more preferred. As already noted, if the target value of weight percent olefins as determined by $^{1}H$ NMR exceeds the desired value, the base oil is hydroprocessed, preferably by hydrofinishing, until the desired target value is achieved.

DETAILED DESCRIPTION OF THE INVENTION

Figure 1:
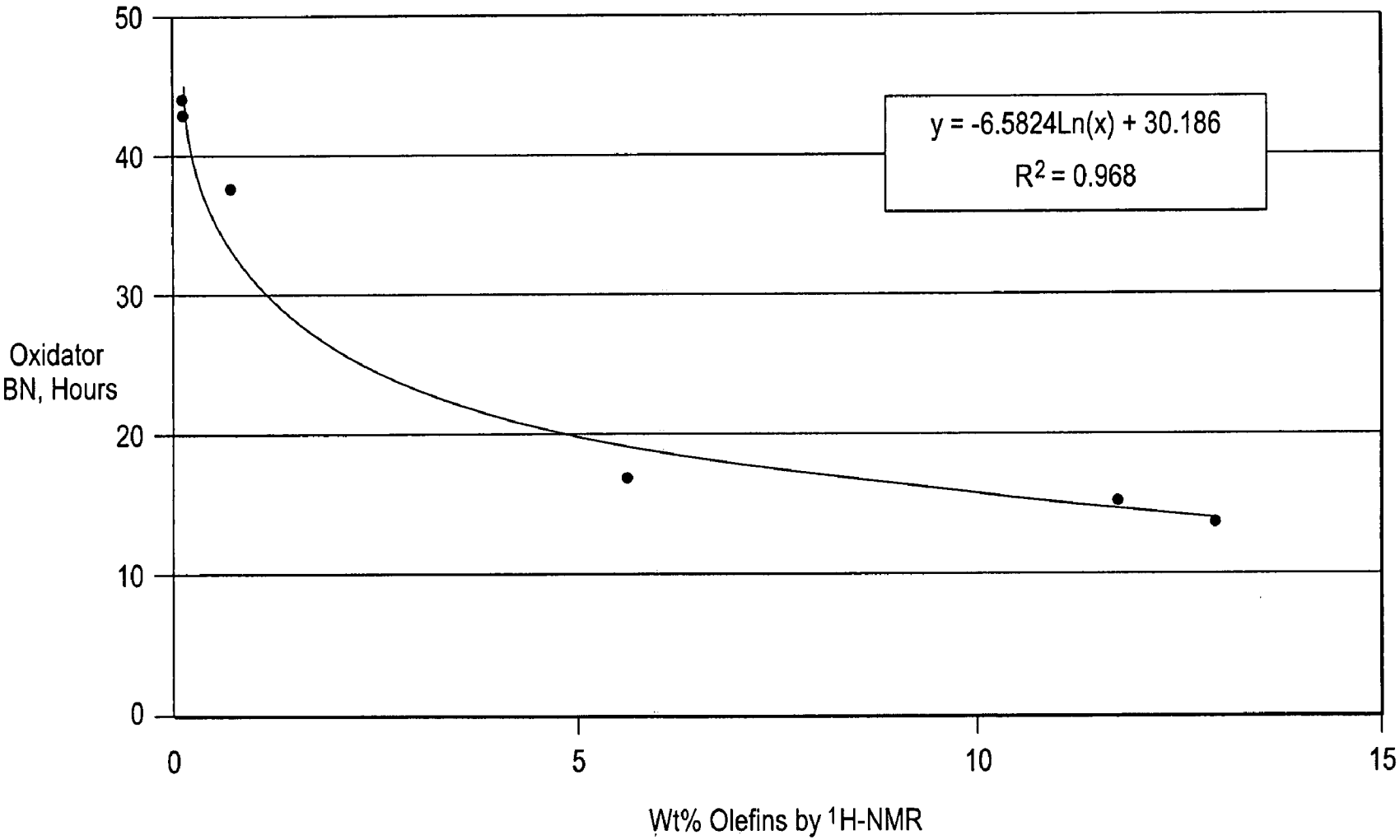
FIG. 1 represents a graph illustrating a typical correlation between Oxidator BN values for a Fischer-Tropsch derived base oil and the weight percent of olefins present as determined by $^{11}H$ NMR.

Base oils are usually prepared from hydrocarbon feedstocks having a major portion boiling above about 340° C. (about 650° F.). Typically, the feedstocks from which lubricating base oils are prepared are recovered as part of the bottoms from an atmospheric distillation unit. This high boiling bottoms material may be further fractionated in a vacuum distillation unit to yield cuts with pre-selected boiling ranges. Most lubricating base oils are prepared from that fraction or fractions where a major portion boils above about 370° C. (about 700° F.) and below about 565° C. (about 1050° F.).

Base oils traditionally have been prepared from conventional petroleum feedstocks and from synthetic hydrocarbons, such as PAOs. Recent studies have shown that high quality lubricating base oils also can be prepared from unconventional waxy feedstocks. The term "waxy feed" as used in this disclosure refers to a feed having a high content of normal paraffins (n-paraffins). A waxy feed useful in the practice of the process of the invention will generally comprise at least 40 wt. % n-paraffins, preferably greater than 50 wt. % n-paraffins, and more preferably greater than 75 wt. % n-paraffins. Examples of waxy feeds that may be used in the present invention include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof.

Suitable feedstocks boiling within the range of base oils may be prepared from lower molecular weight hydrocarbons by oligomerization. The oligomerization of olefins has been well reported in the literature, and a number of commercial processes are available. See, for example, U.S. Pat. Nos. 4,417,088; 4,434,308; 4,827,064; 4,827,073; and 4,990,709. Oligomerization reactions are particularly useful in upgrading Fischer-Tropsch derived hydrocarbons, since Fischer-Tropsch synthesis reactions typically produce large amounts of products boiling in the range of LPG and naphtha which are of lesser commercial value than higher molecular products such as base oils. Oligomerization also introduces desirable branching into the hydrocarbon molecule which lowers the pour point of the lubricating base oil products thereby improving the cold flow properties of the product.

Base oils prepared from a Fischer-Tropsch synthesis reaction are particularly preferred as feed for use in the process of the present invention. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil. As used in this disclosure the phrase "Fischer-Tropsch derived" refers to a hydrocarbon stream in which a substantial portion, except for added hydrogen, is derived from a Fischer-Tropsch process regardless of subsequent processing steps. Accordingly, a "Fischer-Tropsch derived waxy feed" refers to a hydrocarbon product containing at least 40 wt. % n-paraffins which was initially derived from the Fischer-Tropsch process.

Fischer-Tropsch wax is normally solid at room temperature and, consequently, displays poor low temperature properties, such as pour point and cloud point. However, following hydroisomerization of the wax, base oils having excellent low temperature properties may be prepared. Hydroisomerization also tends to increase the amount of olefins and aromatics in the wax. Olefins and aromatics will contribute significantly to the bulk properties of the base oil and particularly to oxidation stability. The presence of olefins and aromatics will decrease oxidation stability. In order to reduce the amount of aromatics and olefins, the waxy feedstock must be hydroprocessed, preferably in a hydrofinishing operation. However, as already noted, conventional methods for determining unsaturation are not suitable for use with hydrocarbons having a 10 wt. % boiling point greater than about 315° C. (about 600° F.). In the present invention, $^1$H NMR is used to accurately determine the weight percent of olefins in the feed. If the olefins exceed a target value which corresponds to the desired oxidation stability of the base oil product, the base oil is further hydrofinished until the target value is achieved.

Oxidation stability may be accurately measured using the Oxidator BN with L-4 Catalyst Test. The Oxidator BN with L-4 Catalyst Test is a test measuring resistance to oxidation by means of a Dornte-type oxygen absorption apparatus (R. W. Dornte "Oxidation of White Oils", Industrial and Engineering Chemistry, Vol. 28, page 26, 1936). Normally, the conditions are one atmosphere of pure oxygen at 340° F. (171° C.), reporting the hours to absorption of 1,000 ml of $O_2$ by 100 gms of oil. In the Oxidator BN with L-4 Catalyst test, 0.8 ml of catalyst is used per 100 gms of oil. The catalyst is a mixture of soluble metal naphthenates in kerosene simulating the average metal analysis of used crankcase oil. The mixture of soluble metal naphthenates simulates the average metal analysis of used crankcase oil. The metals concentration in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 gms of oil, or approximately 1.1 gms of OLOA® 260. The Oxidator BN with L-4 Catalyst Test measures the response of a finished lubricant in a simulated application. High values, or long times to adsorb one liter of oxygen, indicate good stability. OLOA® is an acronym for Oronite Lubricating Oil Additive®, which is a registered trademark of ChevronTexaco Oronite Company.

Acceptable Oxidator BN values for a base oil product will vary with the product and its intended use. Generally a minimum acceptable Oxidator BN value for a Group I base oil will be about 7 hrs. For a Group II base oil a minimum acceptable Oxidator BN value will be about 25 hrs. Following are representative target values for base oil products prepared by various methods as determined in the examples which are part of this disclosure. Base oils prepared by hydroisomerization of Fischer-Tropsch wax that have a kinematic viscosity at 100° C. between 1.5 cSt and 30 cSt (see example 1) should have an Oxidator BN greater than 25 hrs., preferably greater than 35 hrs., more preferably greater than 40 hrs. This corresponds to a target value equal to 5 wt. % of olefins or less. Base oils made by hydroisomerizing Fischer-Tropsch wax should be hydroprocessed such that they comprise 2.2 wt. % or less of olefins as measured by $^1$H NMR, preferably less than or equal to 0.48, more preferably less than or equal to 0.22. Base oils that have a kinematic viscosity at 100° C. above 20 cSt prepared by oligomerizing Fischer-Tropsch olefins (see example 2) should have an Oxidator BN greater than 8 hrs., preferably greater than 10 hrs., more preferably greater than 20 hrs. Thus the Fischer-Tropsch derived base oils prepared by the oligomerization of Fischer-Tropsch condensate should be hydroprocessed such that they contain a weight percent olefins by $^1$H NMR of less than or equal to 14.1, preferably less than or equal to 8.22, and more preferably less than or equal to 1. For base oils made by oligomerizing alpha olefins, that have a kinematic viscosity at 100° C. between 1.5 cSt and 1,000 cSt, (see example 3) should have an Oxidator BN greater than 20 hrs., preferably greater than 25 hrs., more preferably greater than 30 hrs., most preferably greater than 40 hrs. Thus they should be hydroprocessed such that they contain a weight olefins by $^1$H NMR of less than or equal to 15.35, preferably less than or equal to 8.37, more preferably less than or equal to 4.56, and most preferably less than or equal to 1.35. It is desired that base oils made by oligomerizing internal olefins that have a kinematic viscosity at 100° C. between 3.5 cSt and 8.5 cSt, (see example 4) have an Oxidator BN greater than 15 hrs., preferably greater than 25, more preferably greater than 30. Thus they should be processed such that they contain a weight percent olefins by $^1$H NMR of less than or equal to 1.41, preferably less than or equal to 0.90, and more preferably less than or equal to 0.65.

Oligomerization

Oligomerization may be used to increase the molecular weight of hydrocarbons boiling in the range of naphtha and LPG. For example, the yield of heavy products recovered from a Fischer-Tropsch plant, such as lubricating base oil, may be significantly increased by oligomerizing the olefins in the Fischer-Tropsch condensate and those olefins produced by the dehydration of alcohols. During oligomerization the lighter olefins are converted into heavier products. The carbon backbone of the oligomers will also display branching at the points of molecular addition. Due to the introduction of branching into the molecule, the pour point of the products are reduced making the final products of the oligomerization operation excellent products themselves or excellent candidates for blending components to upgrade lower quality conventional petroleum-derived products to meet market specifications. However, as already noted, the oligomerization products being both high boiling and comprising hindered olefins can not be accurately analyzed for olefin content by convention BI.

The oligomerization of olefins has been well reported in the literature, and a number of commercial processes are available. See, for example, U.S. Pat. Nos. 4,417,088; 4,434,308; 4,827,064; 4,827,073; and 4,990,709. Various types of reactor configurations may be employed, with the fixed catalyst bed reactor being used commercially. More recently, performing the oligomerization in an ionic liquids media has been proposed, since the contact between the catalyst and the reactants is efficient and the separation of the catalyst from the oligomerization products is facilitated. Preferably, the oligomerized product will have an average molecular weight at least 10% higher than the initial feedstock, more preferably at least 20% higher. The oligomerization reaction will proceed over a wide range of conditions. Typical temperatures for carrying out the reaction are between about 32° F. (0° C.) and about 800° F. (425° C.). Other conditions include a space velocity from 0.1 to 3 LHSV and a pressure from 0 to 2,000 psig. Catalysts for the oligomerization reaction can be virtually any acidic material, such as, for example, zeolites, clays, resins, $BF_3$ complexes, HF, $H_2SO_4$, $AlCl_3$, ionic liquids (preferably ionic liquids containing a Bronsted or Lewis acidic component or a combination of Bronsted and Lewis acid components), transition metal-based catalysts (such as $Cr/SiO_2$), superacids, and the like. In addition, non-acidic oligomerization catalysts including certain organometallic or transition metal oligomerization catalysts may be used, such as, for example, zirconocenes.

Hydroisomerization

Hydroisomerization is intended to improve the cold flow properties of the base oil by the selective addition of branching into the molecular structure. Hydroisomerization ideally will achieve high conversion levels of the wax to non-waxy iso-paraffins while at the same time minimizing the conversion by cracking. Preferably, the conditions for hydroisomerization in the present invention are controlled such that the conversion of the compounds boiling above about 700° F. in the wax feed to compounds boiling below about 700° F. is maintained between about 10 wt. % and 50 wt. %, preferably between 15 wt. % and 45 wt. %.

Hydroisomerization may be conducted using a shape selective intermediate pore size molecular sieve. Hydroisomerization catalysts useful in the present invention comprise a shape selective intermediate pore size molecular sieve and optionally a catalytically active metal hydrogenation component on a refractory oxide support. The phrase "intermediate pore size," as used herein means an effective pore aperture in the range of from about 3.9 to about 7.1 Å when the porous inorganic oxide is in the calcined form. The shape selective intermediate pore size molecular sieves used in the practice of the present invention are generally 1-D 10-, 11- or 12-ring molecular sieves. The preferred molecular sieves of the invention are of the 1-D 10-ring variety, where 10-(or 11-or 12-) ring molecular sieves have 10 (or 11 or 12) tetrahedrally-coordinated atoms (T-atoms) joined by an oxygen atom. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Å, having a maximum crystallographic free diameter of not more than 7.1 and a minimum crystallographic free diameter of not less than 3.9 Å. Preferably the maximum crystallographic free diameter is not more than 7.1 Å and the minimum crystallographic free diameter is not less than 4.0 Å. Most preferably the maximum crystallographic free diameter is not more than 6.5 Å and the minimum crystallographic free diameter is not less than 4.0 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp. 10-15, which is incorporated herein by reference.

A particularly preferred intermediate pore size molecular sieve, which is useful in the present process is described, for example, in U.S. Pat. Nos. 5,135,638 and 5,282,958, the contents of which are hereby incorporated by reference in their entirety. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å.

The catalyst has sufficient acidity so that 0.5 gins thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40% or greater (isomerization selectivity is determined as follows: 100× (weight percent branched $C_{16}$ in product)/(weight percent branched $C_{16}$ in product+weight percent $C_{13}$ in product) when used under conditions leading to 96% conversion of normal hexadecane (n-$C_{16}$) to other species.

Such a particularly preferred molecular sieve may further be characterized by pores or channels having a crystallographic free diameter in the range of from about 4.0 Å to about 7.1 Å, and preferably in the range of 4.0 to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp. 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al., J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 mins. (p/po=0.5 at 25° C.). Intermediate pore size molecular sieves will typically admit molecules having kinetic diameters of 5.3 to 6.5 Å with little hindrance.

Hydroisomerization catalysts useful in the present invention comprise a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 to 5 wt. % of the total catalyst, usually from 0.1 to 2 wt. % and not to exceed 10 wt. %.

The refractory oxide support may be selected from those oxide supports, which are conventionally used for catalysts, including silica, alumina, silica-alumina, magnesia, titania and combinations thereof.

The conditions for hydroisomerization will be tailored to achieve a Fischer-Tropsch derived lubricant base oil fraction comprising greater than 5 wt. % molecules with cycloparaffinic functionality, and a ratio of weight percent of molecules with monocycloparaffinic functionality to weight percent of molecules with multicycloparaffinic functionality of greater than 15.

The conditions for hydroisomerization will depend on the properties of feed used, the catalyst used, whether or not the catalyst is sulfided, the desired yield, and the desired properties of the lubricant base oil. Conditions under which the hydroisomerization process of the current invention may be carried out include temperatures from about 550° F. to about 775° F. (288° C. to about 413° C.), preferably 600° F. to about 750° F. (315° C. to about 399° C.), more preferably about 600° F. to about 700° F. (315° C. to about 371° C.). The liquid hourly space velocity during contacting is generally from about 0.1 to 20 $hr^{-1}$, preferably from about 0.1 to about 5 $hr^{-1}$. Hydrogen is present in the reaction zone during the hydroisomerization process, typically in a hydrogen to feed ratio from about 0.5 to 30 MSCF/bbl (thousand standard cubic feet per barrel), preferably from about 1 to about 10 MSCF/bbl. Hydrogen may be separated from the product and recycled to the reaction zone. Suitable conditions for performing hydroisomerization are described in U.S. Pat. Nos. 5,282,958 and 5,135,638, the contents of which are incorporated by reference in their entirety.

Typical pressures in the hydroisomerization zone are from about 15 to 3,000 psig, preferably 100 to 2,500 psig. Particularly preferred are pressures of 500 psig or less. The hydroisomerization dewaxing pressures in this context refer to the hydrogen partial pressure within the hydroisomerization reactor, although the hydrogen partial pressure is substantially the same (or nearly the same) as the total pressure. Lower pressure in the hydroisomerization is generally preferred because less cracking takes place. However, lower pressures also result in the production of olefins and aromatics in the base oil recovered from the hydroisomerization zone.

Hydroisomerization generally will increase the amount of olefins and aromatics in the product recovered from the hydroisomerization zone as compared to the feed entering the zone. In most cases the effluent from the hydroprocessing zone will exceed the specification for olefins and aromatics content for the base oil. Therefore, a hydroprocessing step, usually hydrofinishing, is necessary to saturate the double bonds present in the molecules and impart oxidation stability.

Hydrofinishing

Hydrofinishing operations are intended to improve the oxidation stability and color of the products. It is believed this is accomplished by saturating the double bonds present in the hydrocarbon molecule which also reduces the amount of both aromatics and olefins to a low level. A general description of the hydrofinishing process may be found in U.S. Pat. Nos. 3,852,207 and 4,673,487. As used in this disclosure the term oxidation stability refers to the stability of the lubricating base oil when exposed to ultraviolet light and oxygen. Instability is indicated when a visible precipitate forms or darker color develops upon exposure to ultraviolet light and air which results in a cloudiness or floc in the base oil. Lubricating base oils generally will require oxidation stabilization before they are suitable for use in the manufacture of commercial lubricating oils.

Temperature ranges in the hydrofinishing reactor are usually in the range of from about 300° F. (150° C.) to about 700° F. (370° C.), with temperatures of from about 400° F. (205° C.) to about 500° F. (260° C.) being preferred. The LHSV is usually within the range of from about 0.2 to about 2.0, preferably 0.2 to 1.5 and most preferably from about 0.7 to 1.0. Hydrogen is usually supplied to the hydrofinishing reactor at a rate of from about 1,000 to about 10,000 SCF per barrel of feed. Typically the hydrogen is fed at a rate of about 3,000 SCF per barrel of feed.

Preferably, the hydrofinishing zone when operated in association with a hydroisomerization operation will be operated at about the same pressure as the hydroisomerization zone. Thus in the present invention, when the hydrofinishing operation follows the hydroisomerization operation, the hydrofinishing reactor may be operated at a pressure of 750 psig or less, more preferably at 500 psig or less. However, at these lower pressures the olefins may not be saturated to a sufficient degree to meet the oxidation stability specifications for the base oil. In this instance, the hydrofinished base oil may undergo a second hydrofinishing step prior to its use in formulating finished lubricating oil. The additional hydrofinishing step may involve recycling the base oil to the hydrofinishing reactor or sending all or part of the base oil to a second hydrofinishing reactor operated at a higher pressure. When operated at a higher temperature, the pressure in the hydrofinishing zone will preferably be above about 1,000 psig, and most preferably will be above 1,500 psig. The maximum total pressure is not critical to the hydrofinishing process, but due to equipment limitations the total pressure will not exceed 3,000 psig and usually will not exceed about 2,500 psig.

Suitable hydrofinishing catalysts typically contain a Group VIII noble metal component together with an oxide support. Metals or compounds of the following metals are contemplated as useful in hydrofinishing catalysts include ruthenium, rhodium, iridium, palladium, platinum, and osmium. Preferably the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. Nos. 3,852,207; 4,157,294; and 4,673,487.

The hydrofinishing step will usually follow the hydroisomerization operation, however, a hydrofinishing step may take place prior to the hydroprocessing step in some instances. For example, the waxy feed recovered from Fischer-Tropsch synthesis operation typically contains significant amounts of alcohols which may be converted into olefins by hydrofinishing the feed. If these alcohols interfere with downstream processing, such as poisoning of the hydroisomerization catalyst, a separate hydrofinishing step may be needed prior to hydroisomerization, i.e., the hydroprocessing step.

Following hydrofinishing, according to the present invention the base oil is analyzed for weight percent olefins to determine if it meets the desired specification for oxidation stability. If the weight percent of olefins is found to be too high, the hydrofinished base oil is further hydrofinished until the specification is either met or exceeded.

Olefin Analysis Using $^1$H NMR

In order to determine if the base oil will meet the desired oxidation stabilization specification, according to the present invention the base oil is analyzed for the weight percent of olefins present. If the amount of olefins in the base exceeds a predetermined target value which corresponds to the specification, the base oil must be hydroprocessed, usually involving hydrofinishing, to reduce the amount of olefins to the desired level.

The method for determining the weight percent of olefins by $^1$H NMR is determined by the following steps, A-D:

A. Prepare a solution of 5-10% of the test hydrocarbon in deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30° pulse is applied, the instrument must have a minimum signal digitization dynamic range of 65,000. Preferably the dynamic range will be 260,000 or more.

C. Measure the integral intensities between:
   6.0-4.5 ppm (olefin)
   2.2-1.9 ppm (allylic)
   1.9-0.5 ppm (saturate)

D. Using the molecular weight of the test substance determined by ASTM D 2502 or ASTM D 2503, calculate:
   1. The average molecular formula of the saturated hydrocarbons
   2. The average molecular formula of the olefins
   3. The total integral intensity (=sum of all integral intensities)
   4. The integral intensity per sample hydrogen (=total integral/number of hydrogens in formula)
   5. The number of olefin hydrogens (=olefin integral/integral per hydrogen)
   6. The number of double bonds (=olefin hydrogen times hydrogens in olefin formula/2)
   7. The weight percent olefins by $^1$H NMR=100 times the number of double bonds times the number of hydrogens in a typical olefin molecule divided by the number of hydrogens in a typical test substance molecule.

The weight percent of olefins by $^1$H NMR calculation procedure, D, works best when the percent olefins result is low, less than about 15 wt. %. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present. Those skilled in the art will recognize that the calculation process is accurate only for internal olefins. It overstates the olefin concentration for alpha olefins and understates the olefin concentration for tri-substituted olefins. However, the calculation process provides a practical result more useful than BI. When tri- and tetra-substituted olefins predominate, the number of double bonds is calculated from the allylic integral by assuming seven allylic protons per double bond. The assumption is accurate for a 50-50 split between the tri- and tetra-substituted olefins in the mixture.

Unlike BI, $^1$H NMR has been found to give accurate values for high boiling base oils and products which contain hindered olefins. As shown in the following examples, the values for olefin weight percent present in the base oil product obtained by $^1$H NMR may be correlated with oxidation stability.

The present invention may be further clarified by reference to the following examples which are not intended to represent a limitation on the scope of the invention.

EXAMPLES

Example 1

A wax sample composed of several different batches of hydrotreated Fischer-Tropsch wax, all made using a Co-based Fischer-Tropsch catalyst, and was prepared. The different batches of wax comprising the wax sample were analyzed and found to have the general properties as shown in Table 1.

TABLE 1

| Fischer-Tropsch Wax | |
|---|---|
| Fischer-Tropsch Catalyst | Co-Based |
| Sulfur, ppm | <10 |
| Nitrogen, ppm | <10 |
| Oxygen, wt. % | <0.50 |
| ASTM D 6352 SIMDIST TBP (WT. %), ° F. | |
| T10 | 550-700 |
| T90 | 1,000-1080 |
| T90-T10, ° C. | >154 |

The Co-based Fischer-Tropsch wax was hydroisomerized over a Pt/SAPO-11 catalyst with an alumina binder. Operating conditions included temperatures between 635° F. and 675° F. (335° C. and 358° C.), LHSV of 1.0 hr$^{-1}$, reactor pressure of about 500 psig, and once-through hydrogen rates of between 5 and 6 MSCF/bbl. The reactor pressure was kept low, in order to increase the yield of base oil and decrease hydrocracking into lighter boiling products.

The reactor effluent passed directly to a second reactor containing a Pd on silica-alumina hydrofinishing catalyst also operated at 500 psig. Conditions in the second reactor included a temperature of about 450° F. (232° C.) and an LHSV of 2.0 hr$^{-1}$. The hydrofinishing temperature was selected to provide products that had UV-absorbance values at 272 nm of between 0.03 and 0.1 au.cc/g; and UV-absorbance values at 310 nm less than 0.1 au.cc/g. These are UV-absorbance values that have corresponded to high oxidation stability in the manufacture of conventional Group III base oils. UV absorbance in these ranges is a measure of the aromatics content in the base oil, which was believed to be the primary form of unsaturates in the hydroisomerized base oil.

The products boiling above 650° F. were fractionated by vacuum distillation to produce distillate fractions of three different viscosity grades. Test data on the three Fischer-Tropsch derived lubricant base oils are shown in Table 2, below.

TABLE 2

| Fischer-Tropsch Derived Lubricant Base Oils | Sample ID | | |
|---|---|---|---|
| | A | B | C |
| Properties | | | |
| Viscosity at 100° C., cSt | 3.926 | 9.716 | 16.48 |
| Viscosity Index | 142 | 151 | 149 |
| SIMDIST TBP (WT. %), ° F. | | | |
| 5 | 657 | 804 | 991 |
| 10 | 708 | 887 | 1000 |
| 20 | 750 | 973 | 1016 |
| 30 | 770 | 991 | 1035 |
| 50 | 808 | 1012 | 1072 |
| 70 | 858 | 1041 | 1125 |
| 90 | 926 | 1071 | 1227 |
| 95 | 948 | 1085 | 1285 |
| Molecular Weight, ASTM D 2503 | 389 | 582 | 808 |
| $^1$H NMR Data | | | |
| Formula olefin H | 55.29 | 82.86 | 115.14 |
| Saturate H | 57.29 | 84.86 | 117.14 |
| div/H | 5.21 | 3.88 | 7.72 |
| olefin H | 0.23 | 0.26 | 0.11 |
| Sample Olefin H | 6.71 | 10.95 | 6.60 |
| Wt. % Olefins by $^1$H NMR | 11.71 | 12.90 | 5.64 |
| Oxidator BN, hours | 14.64 | 12.91 | 16.22 |

Even though the UV-absorbance was maintained at an acceptable low level during hydrofinishing, it was found that the Oxidator BN results were much lower than expected. It is preferable to obtain base oils made from Fischer-Tropsch wax that have oxidation stabilities by Oxidator BN greater than 25 hrs. It was not possible to correlate the oxidation stabilities with BI results, so it was not initially appreciated that significant amounts of olefins remained in the oils. It was found that the oxidation stability could be better predicted and monitored by using weight percent olefins by $^1$H NMR instead of UV-absorbance or BI measurements in these oils that were hydroisomerized under low pressure.

The three distilled Fischer-Tropsch derived lubricant base oils shown in Table 2 were passed to a micro-unit reactor containing a Pd on silica-alumina hydrofinishing catalyst operated at 1,000 psig. Conditions in the micro-unit reactor included a temperature of about 450° F. (232° C.) and an LHSV of 2.0 hr$^{-1}$. This time the UV-absorbance was not monitored. The properties of the re-hydrofinished samples are summarized in Table 3.

TABLE 3

Re-Hydrofinished Fischer-Tropsch Derived Lubricant Base Oils

| | Sample ID | | |
|---|---|---|---|
| | D | E | F |
| Properties | | | |
| Approx. Kinematic Viscosity at 100° C., cSt | 3.9 | 9.4 | 16.5 |
| Molecular Weight, ASTM D 2503 | 411 | 692 | 870 |
| $^1$H NMR Data | | | |
| Formula olefin H | 58.43 | 98.57 | 124.00 |
| Saturate H | 60.43 | 100.57 | 126.00 |
| div/H | 498.01 | 71.01 | 418.23 |
| olefin H | 0.00 | 0.01 | 0.00 |
| Sample Olefin H | 0.06 | 0.71 | 0.15 |
| Wt. % Olefins by $^1$H NMR | 0.10 | 0.70 | 0.12 |
| Oxidator BN, hours | 43.97 | 37.53 | 42.90 |
| Difference in Wt. % Olefins by $^1$H NMR in Synthesized Product and Re-Hydrofinished Base Oil | 11.61 | 12.2 | 5.52 |

The weight olefins by $^1$H NMR and oxidation stability results were strongly correlated. The weight percent of olefins by $^1$H NMR and oxidation stability from Tables 2 and 3 are plotted in the Figure. It is shown that with a $R^2$=0.968, the oxidation stability of the Fischer-Tropsch derived lubricant base oils were related by the following equation: Oxidator BN=−6.5824×Ln (Wt. % Olefins by $^1$H NMR)+30.19. The presence of olefins in Fischer-Tropsch derived lubricant base oils was not accurately measurable previously, and the strong effects that the olefins had on oxidation stability was also not previously appreciated. The properties of the re-hydrofinished oils are shown in Table 3.

It is desired that base oils made by hydroisomerizing Fischer-Tropsch wax that have a kinematic viscosity at 100° C. between 1.5 cSt and 30 cSt have an Oxidator BN greater than 25 hrs., preferably greater than 35 hrs., more preferably greater than 40 hrs. From these results we can conclude that a weight percent of olefins of greater than or equal to 5 is an unacceptable level. Thus the base oils made by hydroisomerizing Fischer-Tropsch wax should be processed such that they have an acceptable weight percent olefins by $^1$H NMR of less than or equal to 2.2, preferably less than or equal to 0.48, more preferably less than or equal to 0.22. The processing to obtain these low levels of olefins was by hydrofinishing.

Example 2

Four lubricating base oils were made by oligomerizing Fischer-Tropsch derived olefins over an ionic liquid catalyst. After oligomerization, three of them were hydroisomerized (G, H, and I) over a Pt/SSZ-32 molecular sieve on an alumina support. The hydroisomerization conditions included a total pressure of 1,000 psig, LHSV between 0.5 and 1.0, MSCF/bbl of 4, and temperatures between 600 and 615° F. The hydrofinishing conditions for samples G, H, and I were similar in many respects to the hydroisomerizing conditions. The hydrofinishing catalyst was a Pd/Pt silica alumina hydrofinishing catalyst. The hydrofinishing temperatures were between 450 and 500° F. The hydrofinishing conditions for sample J were more severe. Sample J was hydrofinished over a Pt silica alumina hydrofinishing catalyst at 2,000 psig total pressure, 5 MSCF/bbl, and 500° F. The properties of these four base oils are shown in Table 4.

TABLE 4

Oligomerized Fischer-Tropsch Derived Lubricant Base Oils

| | Sample ID | | | |
|---|---|---|---|---|
| | G | H | I | J |
| Properties | | | | |
| Viscosity at 100° C., cSt | 20.8 | 21.22 | 24.76 | 23.53 |
| Viscosity Index | 137 | 136 | 132 | 131 |
| Molecular Weight, ASTM D 2503 | 790 | 790 | 796 | |
| $^1$H NMR Data | | | | |
| Formula Olefin H | 112.6 | 112.6 | 113.4 | Not tested |
| Saturate H | 114.6 | 114.6 | 115.4 | |
| Total Integral | 736 | 1002.4 | 475.3 | |
| div/H | 6.42 | 8.75 | 4.12 | |
| Olefin integral | 1.05 | 1.17 | 1 | |
| Olefin H | 0.16 | 0.13 | 0.24 | |
| Sample olefin H | 9.20 | 7.53 | 13.77 | |
| Wt. % Olefins by $^1$H NMR | 8.0 | 6.6 | 11.9 | Not tested |
| Oxidator BN, hours | 10.43 | 10.29 | 8.66 | 26.59 |
| Bromine Index | 392 | 332 | 9.8 | 259 |

Again, it was found that the weight percent olefins by $^1$H NMR and oxidation stability results were strongly correlated. It is shown that with a $R^2$=0.8957, the oxidation stability of the oligomerized Fischer-Tropsch derived lubricant base oils were related by the following equation: Oxidator BN=(−0.3391×Wt. % Olefins by $^1$H NMR)+12.79. There was no positive correlation seen between the BI results and oxidation stability.

Example 3

Three commercial samples of Chevron Phillips polyalphaolefin base oils were analyzed for BI, weight percent olefins by $^1$H NMR, and oxidation stability by Oxidator BN. These base oils were made by oligomerization of alpha olefins followed by hydrofinishing. The results of these analyses are summarized in Table 5.

TABLE 5

| Polyalphaolefin Base Oils | Sample ID | | |
|---|---|---|---|
| | K | L | M |
| Properties | | | |
| Viscosity at 100° C., cSt | 1.726 | 6.903 | 9.021 |
| Viscosity Index | | 149 | 145 |
| Sim Dist TBP (WT. %), ° F. 10% Point | 608 | 875 | 889 |
| Molecular Weight, ASTM D 2503 | 291 | 565 | 667 |
| $^1$H NMR Data | | | |
| Form Olefin H | 41.29 | 80.43 | 95.0 |
| Saturate H | 43.29 | 82.43 | 97.0 |
| Total Integral | 1622.6 | 544.65 | 1021.1 |
| div/H | 37.49 | 6.61 | 10.53 |
| Olefin integral | 1 | 1 | 1 |
| Olefin H | 0.027 | 0.15 | 0.10 |
| Sample olefin H | 0.58 | 6.24 | 4.61 |
| Wt. % Olefins by $^1$H NMR | 1.33 | 7.57 | 4.75 |
| Oxidator BN, hours | 40.07 | 25.62 | 29.94 |
| Bromine Index | 419 | 185 | 73 |

The results illustrate that the weight percent olefins by $^1$H NMR and oxidation stability results were again strongly correlated. The data show that with a $R^2$=0.9989, the oxidation stability of the polyalphaolefin base oils were related by the following equation: Oxidator BN=−8.235×Ln (Wt. % Olefins by $^1$H NMR)+42.49. The results show that the $^1$H NMR method is useful across the full range of polyalphaolefin viscosities, including the ultra-high viscosity PAOs that have kinematic viscosities as high as 1,000 cSt at 100° C. and the lower weight PAOs such as demonstrated by sample K. As demonstrated in the previous examples, there was no positive correlation seen between the BI results and oxidation stability. These results demonstrate that testing for oxidation stability by measuring weight percent olefins by $^1$H NMR is useful for a broad range of base oils, and is especially valuable when olefins are not readily determined due to molecular interference or high boiling points, as is the case with oligomerized base oils.

Example 4

Three commercial samples of Sasol poly internal olefin base oils made by the oligomerization of internal olefins were analyzed for BI, weight percent olefins by $^1$H NMR, and oxidation stability by Oxidator BN. The results of these analyses are summarized in Table 4.

TABLE 4

| Poly Internal Olefin Base Oils | Sample ID | | |
|---|---|---|---|
| Properties | N | O | P |
| Viscosity at 100° C., cSt | 3.974 | 5.676 | 8.013 |
| Viscosity Index | 125 | 134 | 131 |
| Molecular Weight, ASTM D 2503 | 402 | 472 | 581 |

TABLE 4-continued

| Poly Internal Olefin Base Oils | Sample ID | | |
|---|---|---|---|
| Properties | N | O | P |
| Form Olefin H | 57.142 | | 82.714 |
| Saturate H | 59.142 | | 84.714 |
| Total Integral | 5673.8 | | 3170.0 |
| div/H | 95.934 | | 37.420 |
| Olefin integral | 1 | | 1 |
| Olefin H | 0.0104 | | 0.0267 |
| Sample olefin H | 0.308 | | 1.132 |
| Wt. % Olefins by $^1$H NMR | 0.52 | 0.86 | 1.34 |
| Oxidator BN, hours | 32.88 | 25.26 | 16.72 |
| Bromine Index | Not tested | 41 | Not tested. |

Figure 2:
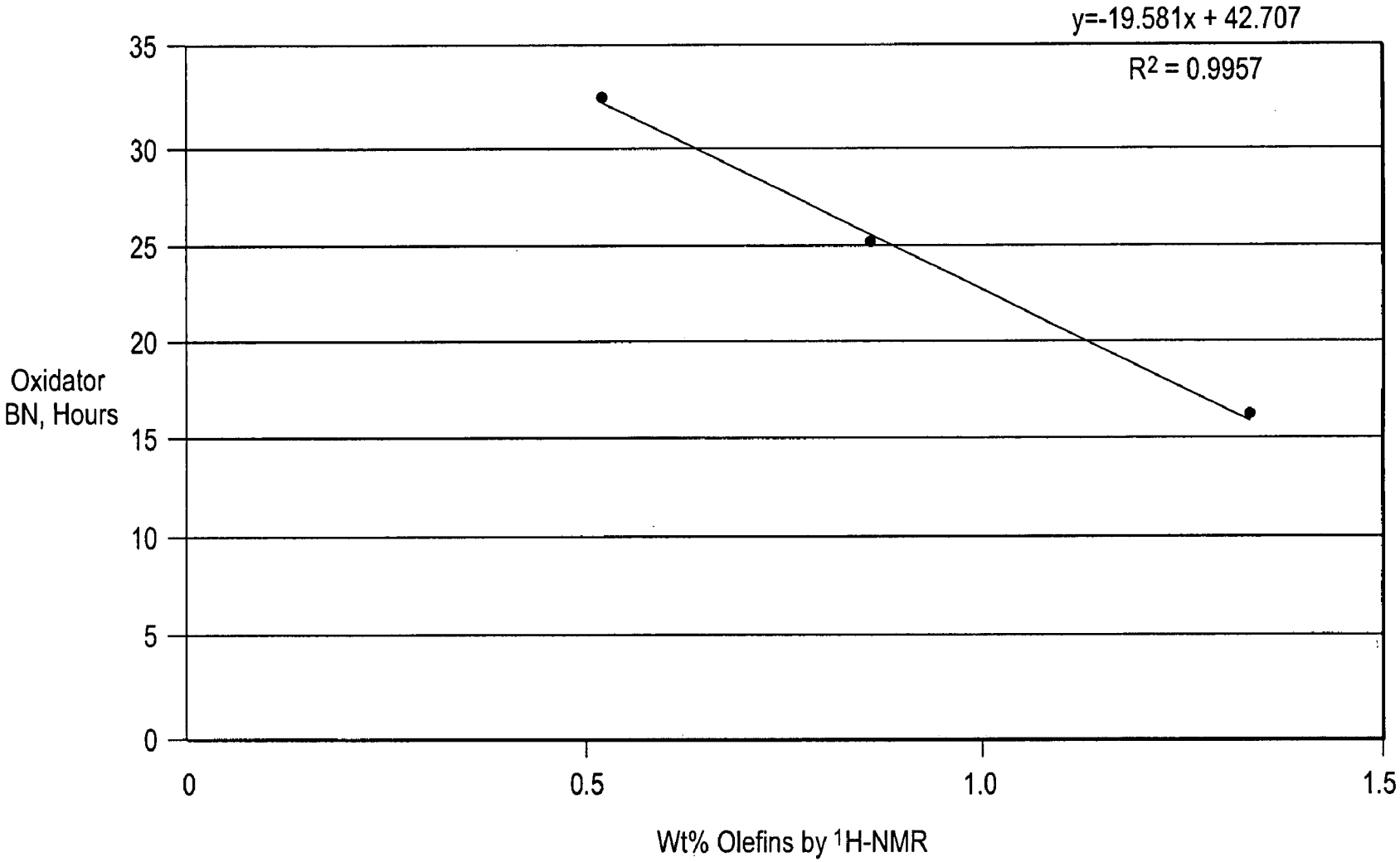
FIG. 2 represents a graph illustrating a typical correlation between Oxidator BN values for a base oil prepared by the oligomerization of internal olefins and the weight percent of olefins present in the oligomerization product as determined by $^{1}H$ NMR.

Again, for a third type of oligomerized base oil it was found that the weight percent olefins as determined by $^1$H NMR and oxidation stability results were strongly correlated. The results for weight percent olefins by $^1$H NMR and oxidation stability data from Tables 4 are plotted in FIG. 2. It is shown that with a $R^2$=0.9957, the oxidation stability of the poly internal olefin base oils were related by the following equation: Oxidator BN=(−19.581×Wt. % Olefins by $^1$H NMR)+42.71.

What is claimed is:

1. A process for producing a lubricating base oil having high oxidation stability, wherein the feed used to prepare the lubricating base oil contains between 5 and 15 wt. % olefins and has a kinematic viscosity at 100° C. between 1.5 cSt and 1,000 cSt, said process comprising:

a. determining the weight percent of olefins present in the feed by means of $^1$H NMR;

b. hydroprocessing the feed under hydroprocessing conditions selected to reduce the amount of olefins present to a target value which has been pre-determined by means of $^1$H NMR to produce a lubricating base oil having the desired oxidation stability; and c. collecting a lubricating base oil having the selected oxidation stability from the hydroprocessing zone.

2. The process of claim 1 wherein the feed used to prepare the lubricating base oil contains between 5 and 12.9 wt. % olefins.

3. The process of claim 1 wherein the feed comprises a poly alpha olefin.

4. The process of claim 1 wherein the feed comprises an poly internal olefin.

5. The process of claim 1 wherein the feed is derived from an oligomerization reaction.

6. The process of claim 1 wherein the feed is petroleum derived.

7. The process of claim 1 wherein the feed is a Fischer-Tropsch derived.

8. The process of claim 1 wherein the feed is hydroisomerized prior to determining the weight percent of olefins present in step (a).

9. The process of claim 1 wherein the hydroprocessing of step (b) includes hydroisomerization of the feed.

10. The process of claim 1 wherein the hydroprocessing of step (b) includes hydrofinishing of the feed.

11. The process of claim 1 wherein the feed is an isomerized feed which has been hydroisomerized prior to the hydroprocessing step (b) in a hydroisomerization zone under hydroisomerization conditions which include a hydroisomerization pressure of less than 500 psig.

12. The process of claim 11 wherein the isomerized feed has also been hydrofinished prior to the hydroprocessing step (b) in a hydrofinishing zone under hydrofinishing conditions which include a hydrofinishing pressure of less than 750 psig.

13. The process of claim 12 wherein the hydrofinishing pressure in the hydrofinishing zone is less than 500 psig.

14. The process of claim 1 wherein the hydrofinishing conditions include a hydrofinishing pressure of greater than 750° psig.

15. The process of claim 1, wherein the teed has a kinematic viscosity at 100° C. between 1.5 cSt and 30 cSt.

16. The process of claim 1, wherein the feed has a kinematic viscosity at 100° C. between 3.5 cSt and 1,000 cSt.

17. The process of claim 16, wherein the feed has a kinematic viscosity between 3.5 cSt and 30 cSt.

18. A process for producing a base oil product having high oxidation stability from a waxy feed, said process comprising:

a. isomerizing the waxy feed in a hydroisomerization zone under hydroisomerization conditions, whereby an isomerized intermediate base oil is produced having (i) increased methyl branching, (ii) greater than 0.01 wt. % aromatics, (iii) a kinematic viscosity at 100° C. between 1.5 cSt and 30 cSt, and (iv) between 5 and 15 wt. % olefins;

b. determining the weight percent of olefins present in the isomerized intermediate base oil by means of $^1$H NMR;

c. if the weight percent of olefins present in the isomerized intermediate base oil as determined in step (b) exceeds a target value pre-selected to correspond to high oxidation stability, hydrofinishing the isomerized intermediate base oil in a hydrofinishing zone under hydrofinishing conditions selected to reduce the amount of olefins present to less than the target value for weight percent of olefins; and d. collecting a base oil product having high oxidation stability from the hydrofinishing zone.

19. The process of claim 18 wherein a significant portion of the olefins present in the isomerized intermediate base oil are internal olefins.

20. The process of claim 18 wherein the waxy feed is derived from a Fischer-Tropsch synthesis.

21. The process of claim 20 wherein the waxy feed is produced by the oligomerization of a Fischer-Tropsch derived product.

22. The process of claim 18 wherein the waxy feed is petroleum derived.

23. The process of claim 18 wherein the isomerized intermediate base oil is also hydrofinished prior to determining the weight percent of olefins in step (b).

24. The process of claim 18 wherein the target value preselected to correspond to high oxidation stability is 15 wt. % or less as measured by $^1$H NMR.

25. The process of claim 24 wherein the target value preselected to correspond to high oxidation stability is 10 wt. % or less as measured $^1$H NMR.

26. The process of claim 25 wherein the target value preselected to correspond to high oxidation stability is 5 wt. % or less as measured by $^1$H NMR.

27. The process of claim 26 wherein the target value preselected to correspond to high oxidation stability is 2.5 wt. % or less as measured by $^1$H NMR.

28. The process of claim 25 wherein the amount of olefins present in the base oil product collected from the hydrofinishing zone in step (d) is reduced to less than about 1 wt. % as measured by means of $^1$H NMR.

29. The process of claim 28 wherein the amount of olefins present in the base oil product collected from the hydrofinishing zone in step (d) is reduced to less than about 0.5 wt. % as measured by means of $^1$H NMR.

30. The process of claim 18 wherein the hydroisomerization conditions include a hydroisomerization pressure of less than 500° psig.

31. The process of claim 18, wherein the isomerized intermediate base oil has a kinematic viscosity between 1.5 cSt and 1,000 cSt.

32. The process of claim 18, wherein the isomerized intermediate base oil has a kinematic viscosity between 3.5 cSt and 1,000 cSt.

33. The process of claim 32, wherein the isomerized intermediate base oil has a kinematic viscosity between 3.5 cSt and 30 cSt.

* * * * *